US008727013B2

(12) United States Patent
Buckley et al.

(10) Patent No.: US 8,727,013 B2
(45) Date of Patent: May 20, 2014

(54) SUBSEA CONTROL MODULE WITH INTERCHANGEABLE SEGMENTS

(75) Inventors: Margaret M. Buckley, Houston, TX (US); David C. Baskett, Houston, TX (US)

(73) Assignee: DTC International, Inc., Houston, TX (US)

( * ) Notice: Subject to any disclaimer, the term of this patent is extended or adjusted under 35 U.S.C. 154(b) by 651 days.

(21) Appl. No.: 12/793,881

(22) Filed: Jun. 4, 2010

(65) Prior Publication Data

US 2010/0307761 A1 Dec. 9, 2010

Related U.S. Application Data

(60) Provisional application No. 61/184,214, filed on Jun. 4, 2009.

(51) Int. Cl.
*E21B 33/038* (2006.01)

(52) U.S. Cl.
USPC ..... 166/339; 166/338; 166/341; 166/344; 166/350; 166/351; 251/28; 251/30.01

(58) Field of Classification Search
CPC ..... E21B 33/038; E21B 33/0355
USPC ..... 166/338, 339, 341, 344, 381, 368, 386; 251/28, 30.01
See application file for complete search history.

(56) References Cited

U.S. PATENT DOCUMENTS

| | | | | |
|---|---|---|---|---|
| 3,460,614 | A * | 8/1969 | Burgess | 166/335 |
| 3,820,600 | A * | 6/1974 | Baugh | 166/338 |
| 4,848,474 | A * | 7/1989 | Parizot et al. | 166/366 |
| 5,456,313 | A | 10/1995 | Hopper et al. | |
| 6,161,618 | A | 12/2000 | Parks | |
| 6,209,565 | B1 | 4/2001 | Hughes | |
| 6,907,932 | B2 * | 6/2005 | Reimert | 166/341 |
| 6,938,695 | B2 | 9/2005 | Williams | |
| 7,784,547 | B2 * | 8/2010 | Reddy | 166/360 |

(Continued)

FOREIGN PATENT DOCUMENTS

| | | | |
|---|---|---|---|
| WO | 00-08297 | A1 | 2/2000 |
| WO | 2009-023195 | A1 | 2/2009 |

OTHER PUBLICATIONS

PCT International Search Report and Written Opinion dated Dec. 28, 2010.
U.S. Appl. No. 12/189,701, filed Aug. 11, 2008.

*Primary Examiner* — James Sayre
(74) *Attorney, Agent, or Firm* — James J. Murphy; Thompson & Knight LLP

(57) ABSTRACT

A subsea control module for subsea well equipment has an actuator having a rod with a remote operated vehicle (ROV) interface on one end and a latch on an opposite end that latches to a subsea receptacle. Segments are releasably mounted around and to the actuator. Each of the segments has a sealed housing containing at least one internal control component. Couplings depend from the housing for engaging mating couplings in the receptacle. The housing has two radial walls, each extending along a radial line from an axis of the rod. An outer wall joins outer ends of the radial walls, the outer wall being a portion of a cylinder. An inner wall joins inner edges of the radial walls. The radial walls of adjacent ones of the segments abut each other.

19 Claims, 4 Drawing Sheets

(56) References Cited

U.S. PATENT DOCUMENTS

2007/0079969 A1* 4/2007 Allenworth ..... 166/368
2008/0029270 A1* 2/2008 Wong et al. ..... 166/338
2009/0038805 A1* 2/2009 Parks et al. ..... 166/341
2009/0194290 A1* 8/2009 Parks et al. ..... 166/339

* cited by examiner

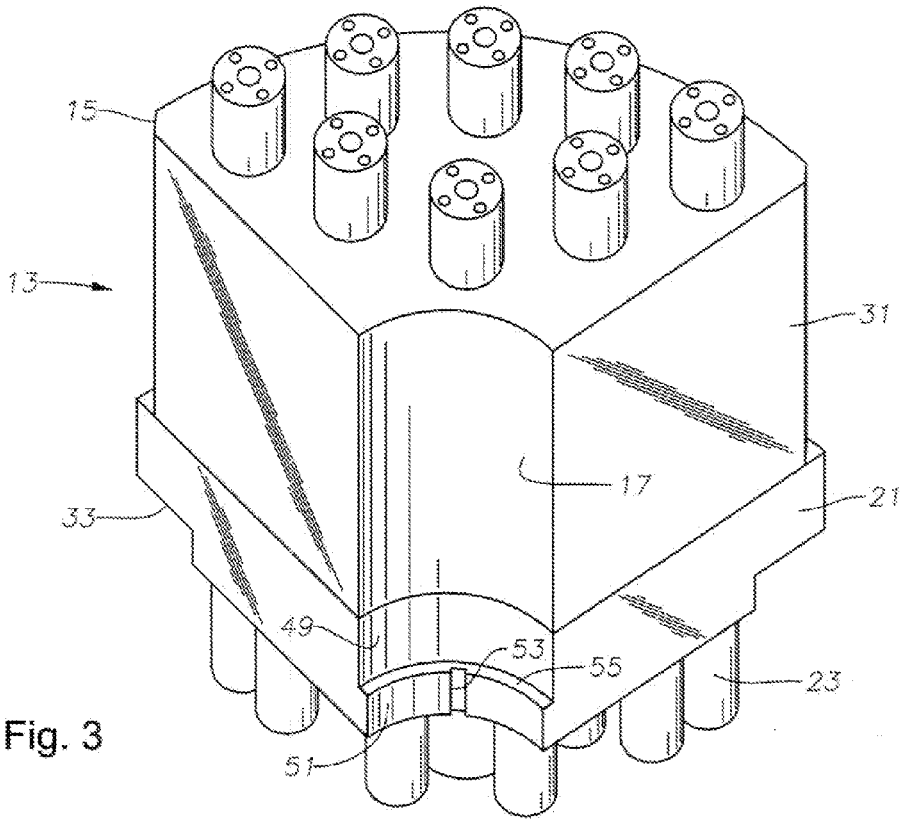
Fig. 3
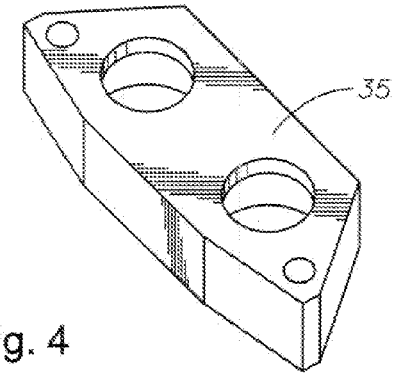
Fig. 4
Fig. 5
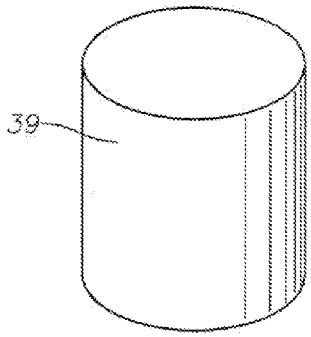

SUBSEA CONTROL MODULE WITH INTERCHANGEABLE SEGMENTS

CROSS-REFERENCE TO RELATED APPLICATION

This application claims priority to provisional application Ser. No. 61/184,214, filed Jun. 4, 2009.

FIELD OF THE INVENTION

This application relates generally to hydraulically controlling valves and connectors of subsea well equipment, such as blowout preventers or production trees, and in particular to a modular control module having interchangeable and standardized compartments.

BACKGROUND OF THE INVENTION

Subsea Control Modules, also called SCM's, are commonly used to provide well control functions during the production phase of subsea oil and gas production. Typical well control functions and monitoring provided by the subsea control module include the following: 1) actuation of fail-safe return production tree actuators and downhole safety valves; 2) actuation of flow control choke valves, shut-off valves, etc.; 3) actuation of manifold diverter valves, shut-off valves, etc.; 4) actuation of chemical injection valves; 5) actuation and monitoring of Surface Controlled Reservoir Analysis and Monitoring Systems (SCRAMS) sliding sleeves, choke valves; 6) monitoring of downhole pressure, temperature and flow rates; and 7) monitoring of sand probes, production tree and manifold pressures, temperatures, and choke positions.

The close proximity of the typical subsea control module to the subsea production tree, coupled with its electro-hydraulic design allows for quick response times of tree valve actuations. The typical subsea control module receives electrical power, communication signals and hydraulic power supplies from surface control equipment. The subsea control module and production tree are generally located in a remote location relative to the surface control equipment. Redundant supplies of communication signals, electrical, and hydraulic power are transmitted through umbilical hoses and cables of various length, linking surface equipment to subsea equipment. Electronics equipment located inside the subsea control module conditions electrical power, processes communications signals, transmits status and distributes power to devices such as solenoid piloting valves, pressure transducers and temperature transducers.

Low flow rate solenoid piloting valves are typically used to pilot high flow rate control valves. These control valves transmit hydraulic power to end devices such as subsea production tree valve actuators, choke valves and downhole safety valves. The status condition of control valves and their end devices are read by pressure transducers located on the output circuit of the control valves. Auxiliary equipment inside the typical subsea control module consists of hydraulic accumulators for hydraulic power storage, hydraulic filters for the reduction of fluid particulates, electronics vessels, and a pressure/temperature compensation system.

Subsea drilling control systems include a large blowout preventer (BOP) systems and a lower marine riser package (LMRP) that allows quick disconnection from the blowout preventer in the event of an emergency. Typically, the BOP has two redundant subsea control modules having electrical and hydraulic components for controlling the BOP and LMRP. Each subsea control module is fairly large and complex as they control many different functions, such as the various rams and closure elements, connectors and the like of the BOP. If a problem is detected, one of the subsea control modules may be retrieved, usually on a lift line, while the other maintains operation of the BOP.

SUMMARY

The subsea control module of this invention is smaller than a typical subsea control module for a subsea tree or for a BOP system so that it can be readily installed and retrieved with a remote operated vehicle (ROV). The subsea control module is made simpler and controls fewer functions than a prior art subsea control module thus subsea equipment, particularly a subsea BOP, will employ many more than two redundant subsea control modules. Preferably, each subsea control module will be located near the particular subsea component, such as a valve.

Each subsea control module has an actuator having a rod with an ROV interface on one end and a latch on an opposite end that latches to a subsea receptacle. A plurality of segments releasably mount circumferentially around and to the rod, each of the segments comprising a sealed housing containing at least one control component therein. A plurality of couplings depend from the housing for engaging mating couplings in the receptacle. Each housing preferably has two radial walls, each extending along a radial line from an axis of the rod. An outer wall joins outer ends of the radial walls, the outer wall being a portion of a cylinder. An inner wall, also, a portion of a cylinder, is concentric with the outer wall. The radial walls of adjacent ones of the segments abut each other.

The segments preferably extend completely around the rod. A shoulder and a mating recess arrangement between an inner portion of each segment and the actuator axially supports the segments on the actuator. Each of the housings has a base plate on one end and a top on an opposite end. The couplings are secured to and depend from the base plate. An external hydraulic valve may be mounted to the top on the exterior of the housing. In one embodiment, fasteners secure the base plates of the housings to each other around the actuator. A sleeve slides over the cylindrical exterior defined by the outer walls.

BRIEF DESCRIPTION OF THE DRAWINGS

FIG. 3 is a perspective top view of the segment of FIG. 2.

FIG. 4 is a perspective view of a link attaching two of the segments of the control module of FIG. 1.

FIG. 5 is a perspective view of a sleeve that slides over the assembled segments of the control module of FIG. 1.

DETAILED DESCRIPTION OF THE INVENTION

Figure 1:
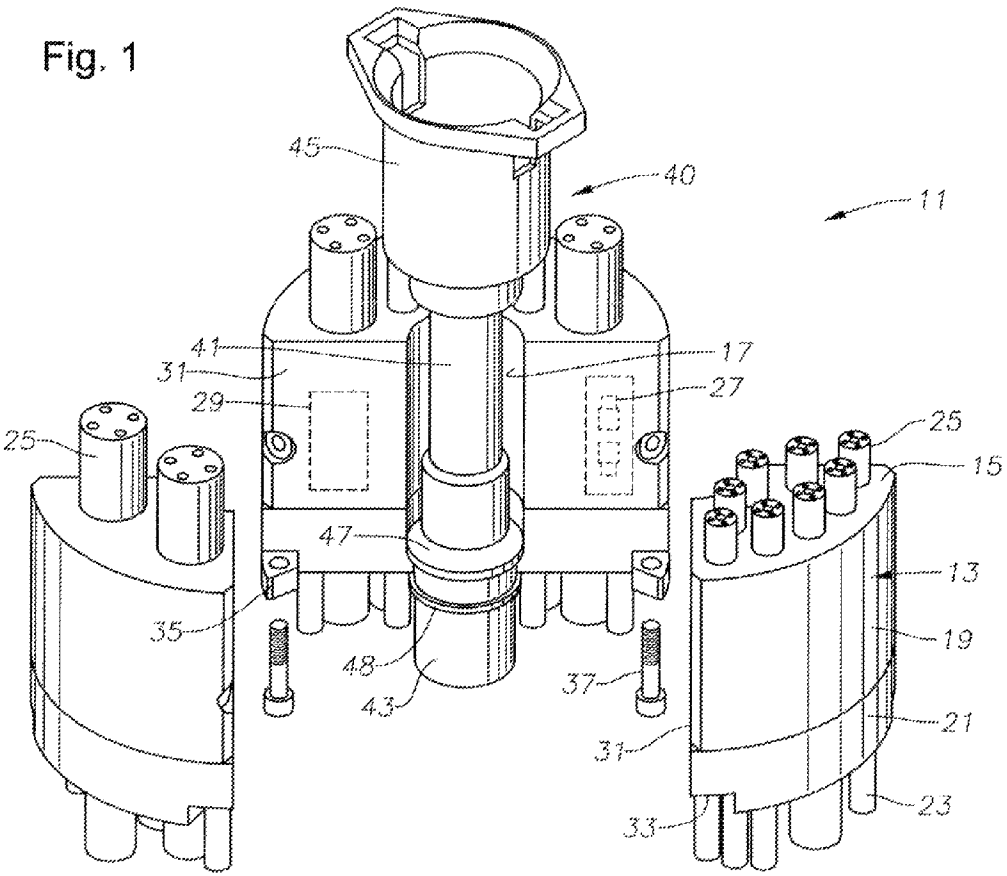
FIG. 1 is an exploded perspective view of a control module constructed in accordance with this invention.

Referring to FIG. 1, subsea control module 11 is made up of a number of compartments or segments 13 that are assembled to define a cylindrical shape in this embodiment. Each segment in this embodiment is generally pie-shaped. Each segment 13 has one or more housings 15 that is separate from the housings of other segments 13. Each housing 15 is sealed from encroachment of water and sealed from housings 15 of adjacent segments 13 of the control module 11. There is no need for having any pressure equalization system within each housing 15; rather the interior of each may remain at atmospheric pressure. Each housing 15 has an inner wall 17 that is a portion of a cylinder and an outer wall 19 that is a portion of a cylinder and is concentric relative to inner wall 17. In this embodiment, each segment 13 extends 90°, resulting in four segments 13 for subsea control module 11. However, that number could vary with fewer or more segments.

Figure 2:
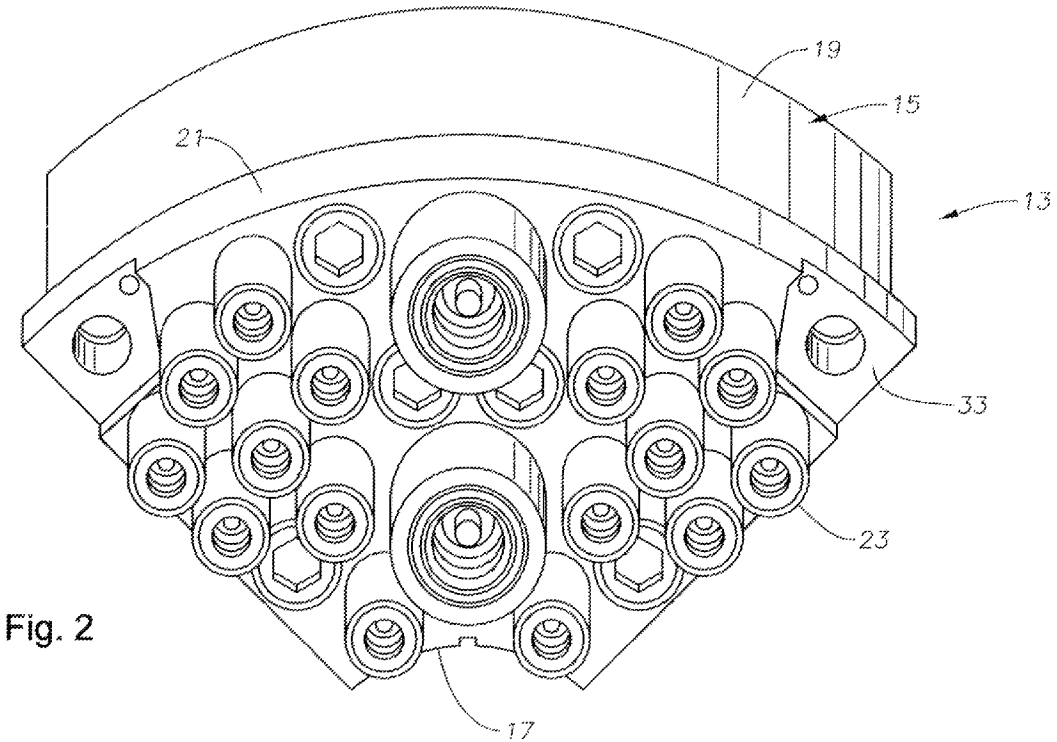
FIG. 2 is a perspective bottom view of one of the segments or compartments of the control module of FIG. 1.

Each segment 13 has a base or flat lower side 21 that may be considered to be a bottom part of housing 15. Lower side 21 is a plate having a flat lower face and passages communicating with various couplings 23. Couplings 23 are secured to the bottom of lower side 21, and as shown in FIG. 2, may differ from each other. Some of the couplings 23 may be hydraulic couplings and others may be electrical couplings and fiber optic couplings. Couplings 23 will engage mating couplings (not shown) of a receptacle (not shown) affixed to part of the subsea equipment, such as a BOP system.

Each segment 13 contains various components that are linked to couplings 23 through openings within lower side 21. These components may vary from one segment 13 to another. Externally mounted valves 25 may be mounted on their top surfaces. As shown in FIG. 1, some of the valves 25 may be larger than others. Also, some segments 13 may have more valves 25 than others. The components within each segment 13 may differ substantially from components contained in other segments 13. For example, one segment 13 may have internal directional control valves 27. Others may contain internal electrical solenoids and electronic circuitry 29. Some may contain internal fluid regulators, while others contain internal fluid filters. Shuttle valves may be located internally within some. A subsea control module 11 could have two or more of the segments 13 having the same internal and/or external components, or the components within and mounted to each segment 13 of a subsea control module 11 could differ. Normally the subsea equipment, such as a lower marine riser package, subsea tree, or BOP assembly, will have receptacles for a number of subsea control modules 11, and many of the control modules will differ from each other because of the different functions that they are intended to perform.

Each segment housing 15 preferably has two radially extending side walls 31 that abut against radially extending side walls 31 of adjacent segments 13. In this example, radially extending sidewalls 31 of each segment 13 are located 90° apart from each other relative to a central axis of subsea control module 11. Lower side 21 of each segment 13 has two fastener recesses 33, which are shown on the lower side and join each radial side wall 31. When segments 13 are abutted, one-half of each fastener recess 33 joins another half of a recess 33 of an adjacent segment 13. A link 35 (FIG. 4) fits within each mated fastener recess 33. Fasteners 37 extend through holes in link 35 into threaded holes in bases 21 of adjoining segments 13 to secure them to each other in the cylindrical configuration. Once assembled, a sleeve 39 (FIG. 5) slides over the assembly.

Subsea control module 11 has an actuator 40 for releasably securing it to a subsea receptacle with the use of an ROV. Actuator 40 has a rod 41 that extends along a longitudinal axis of actuator 40 within the cylindrical bore defined by the mating inner walls 17. Rod 41 has a collet latch 43 on its lower end. Collet latch 43 protrudes below bases 21 for insertion over a mating latch member (not shown) in the receptacle of the subsea equipment. An ROV interface 45 is located at the upper end of rod 41. An ROV will engage interface 45 to convey subsea control module 11 to the desired location on the subsea equipment, then manipulate collet latch 43 to latch control module 11 in place. ROV interface 45 and collet latch 43 may be conventional components.

Segments 13 are restricted from movement relative to each other and relative to actuator 40 by vertical restraints, keyed restraints and circumferential expansion. In this example, segments 13 are axially and rotationally attached to actuator 40 by a shoulder and recess arrangement. In this example, as shown in FIG. 1, actuator 40 has an external flange 47 and a circumferential shoulder or rib 48 located below flange 47. Flange 47 and rib 48 are located on an upper portion of collet latch 43 in this example and define a recess between them. Referring to FIG. 3, each lower side 21 has an inner wall 49 that is a portion of a cylinder that may have a slightly smaller diameter dimension than housing inner wall 17. A band 51 protrudes radially inward from base inner wall 49 and may have a key slot 53 for engagement with a mating key on actuator 40. Band 51 has an upward-facing shoulder 55 that is engaged by the lower side of flange 47. Band 51 fits into the recess between flange 47 and rib 48. This recess and shoulder arrangement locks segments 13 to actuator 40 both axially and rotationally. Segments 13 may be positioned around actuator 40, then attached to each other with links 35 and fasteners 37. There is no sealing required between actuator 40 and segments 13 because each housing 15 is separately sealed. Sea water is thus free to enter the space between actuator 40 and housing inner walls 17. Many other arrangements to secure segments 13 to actuator 40 are feasible.

Figure 6:
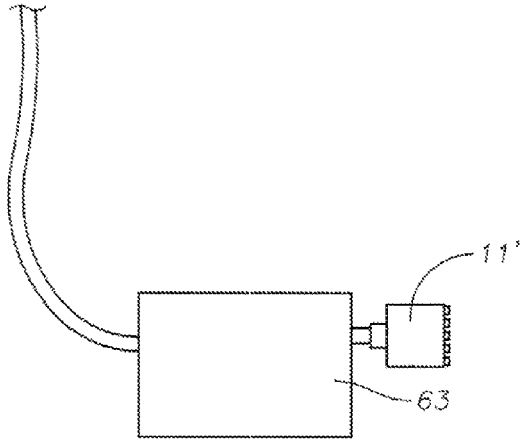
FIG. 6 is a schematic view illustrating a second control module being delivered by a remote operated vehicle to replace a first control module coupled to subsea well equipment.
Figure 6:
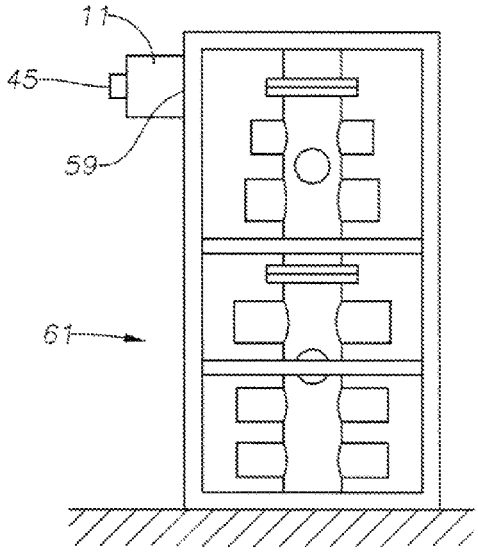

Referring to FIG. 6, subsea equipment 61, such as a BOP, is shown schematically. Once connected with a receptacle 59 of the subsea equipment 61, subsea control module 11 will operate in the same manner as a conventional control module. If a malfunction occurs, preferably an ROV 63 will be deployed along with a replacement subsea control module 11'. The ROV 63 will temporarily park the replacement subsea control module 11', then engage interface 45 and remove the malfunctioning control module 11. The ROV 63 inserts the replacement control module 11' and returns the defective control module 11 to the surface for repair or replacement. Once the fault is identified, the operator may replace the faulty segment or segments 13, reassemble the segments 13 and re-use control module 11 at a later time.

Although a particular subsea control module 11 may contain different components within each of its segments 13, many of those segments can be standardized. For example, a segment 13 having filtration components may be the only segment containing filtration components of particular control module 11. If more filtration capacity is required, additional segments 13 having the same filtration components may be added to the same or a different control module 11. The segments 13 having filtration components could be standardized.

As another example, a portion of the subsea equipment to be controlled by one subsea control module 11 may require four directional control valves 27. Assuming, for example, that standardized segments 13 having two directional control valve 27 were available, the operator would then mount two of these segments 13 on the same control module 11. This system thus enables an operator to provide many variations for subsea control modules 11 without having to completely design each different control module. This system allows designers to configure a subsea control module in an extremely short time frame as compared to standard practice.

While the invention has been shown in only one of its forms, it should be apparent to those skilled in the art that it is not so limited but is subject to various modifications without departing from the scope of the claims.

What is claimed is:

1. A subsea control module for subsea well equipment, comprising:

an actuator having a rod with a remote operated vehicle (ROV) interface on one end and a latch on an opposite end that latches to a subsea receptacle;

a plurality of segments releasably mounted circumferentially around and to the rod, each of the segments comprising a sealed housing containing a control component therein;

a plurality of couplings depending from the housing for engaging mating couplings in the receptacle;

wherein each of the housings comprise:

a base plate on one end and a top on an opposite end, wherein the couplings are secured to and depend from the base plate; and each of the segments further comprise:

an external hydraulic valve mounted to the top on the exterior of the housing.

2. The control module according to claim 1, wherein each housing further comprises:

two radial walls, each extending along a radial line from an axis of the rod;

an outer wall joining outer ends of the radial walls, the outer wall being a portion of a cylinder; and wherein the radial walls of adjacent ones of the segments abut each other.

3. The control module according to claim 1, wherein the segments extend completely around the rod.

4. The control module according to claim 1, further comprising:

a shoulder and mating recess between an inner portion of each segment and the actuator for supporting the segments on the actuator.

5. The control module according to claim 1, wherein each of the housings comprise:

an inner wall that is a portion of a cylinder;

an outer wall that is a portion of a cylinder and concentric with the inner wall;

two radial walls joining the inner wall to the outer wall on opposite edges of the inner and outer walls; wherein:

the radial walls of adjacent ones of the housings abut each other; and a plurality of fasteners that secure the housings to each other around the actuator.

6. The control module according to claim 1, wherein:

the segments extend 360 degrees around the actuator and define a cylindrical exterior; and a sleeve extends over the cylindrical exterior of the segments.

7. The control module according to claim 1, wherein the control component in at least one of the housings comprises at least one directional control valve.

8. The control module according to claim 1, wherein the control component in at least one of the housings comprises an electronic control circuit.

9. A subsea control module for subsea well equipment, comprising:

an actuator having a rod with a remote operated vehicle (ROV) interface on one end and a collect latch on an opposite end that latches to a receptacle on subsea well equipment, the rod having an axis;

a plurality of segments releasably mounted circumferentially around and to the actuator, each of the segments comprising a sealed housing;

the housing of each of the segments having an inner wall and an outer wall, the inner and outer walls being partly cylindrical and concentric with each other and having inner and outer edges spaced circumferentially apart from each other, the outer wall being spaced radially farther from the axis than the inner wall, the housing having a two radial side walls, each extending from one of the edges of the inner wall to the one of the edges of the outer wall;

the housing of each of the segments having a base plate and a top;

an internal control component with each of the housings; and a plurality of couplings depending from the base plate of each of the housings for engaging mating couplings in the receptacle, each of the couplings being cooperatively engaged with the inner control component with one of the housings.

10. The control module according to claim 9, further comprising:

an external valve mounted to the top of each of the housings, the external valve being in cooperative engagement with one of the inner control components.

11. The control module according to claim 9, wherein there are at least three of the segments mounted around the actuator.

12. The control module according to claim 9, wherein there are at least four of the segments mounted around the actuator.

13. The control module according to claim 9, wherein:

the outer walls of the segments define a 360 degree cylindrical exterior; and a cylindrical sleeve slides over the outer walls.

14. The control module according to claim 9, wherein the control component in at least one of the housings comprises at least one directional control valve.

15. The control module according to claim 9, wherein the control component in at least one of the housings comprises an electronic control circuit.

16. The control module according to claim 9, further comprising:

a recess formed on a corner of each base plate;

a link that fits into recesses of adjacent ones of the segments; and fasteners that secure the links to the base plates of adjacent ones of the segments.

17. The control module according to claim 9, wherein:

the base plate of each segment has an inner partially cylindrical wall; and the control module further comprises:

a recess and shoulder arrangement between each of the base plates and the actuator for axially securing the segments to the actuator.

18. A method of maintaining control functions of subsea well equipment, comprising:

providing a first and second control modules, each comprising a plurality of segments mounted around an actuator having a rod with a remote operated vehicle (ROV) interface on one end and a latch on an opposite end, each of the segments having a sealed housing containing a control component therein and a plurality of couplings depending from the housing;

securing the latch of the first control module to a receptacle of the subsea well equipment and the couplings of the first control module to mating couplings in the receptacle;

operating the subsea well equipment with the first control module; then when it is desired to change the first control module;

securing an ROV to the ROV interface of the second control module and conveying the ROV to the subsea well equipment;

engaging the ROV interface of the first control module with the ROV and removing the first control module from the receptacle; then with the ROV plugging the second control module into the receptacle, operating the subsea equipment with the second control module and returning to the surface with the first control module; then replacing at least one of the segments of the first control module with another of the segments for re-installation of the first control module.

19. The method according to claim 18, wherein operating the subsea well equipment with the first control module comprises supplying hydraulic fluid pressure and electrical control signals to the internal component in the first control module.

* * * * *